US006340164B1

(12) United States Patent
Borel

(10) Patent No.: US 6,340,164 B1
(45) Date of Patent: Jan. 22, 2002

(54) SKATE, ESPECIALLY AN IN-LINE ROLLER SKATE, FOR "AGGRESSIVE" SKATING

(75) Inventor: René Borel, Saint-Sylvestre (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/525,131

(22) Filed: Mar. 14, 2000

(30) Foreign Application Priority Data

Mar. 15, 1999 (FR) ..... 99 03492

(51) Int. Cl.[7] ..... A63C 17/02

(52) U.S. Cl. ..... 280/11.225; 280/11.224; 280/11.3; 280/11.221; 280/11.32; 36/115

(58) Field of Search ..... 280/11.221, 11.224, 280/11.225, 11.231, 11.3, 11.32; 36/115

(56) References Cited

U.S. PATENT DOCUMENTS

| | | | | | |
|---|---|---|---|---|---|
| 4,132,424 A | * | 1/1979 | Olivieri | 280/11.3 |
| 4,800,657 A | * | 1/1989 | Brown | 36/44 |
| 5,331,752 A | | 7/1994 | Johnson et al. | 36/115 |
| 5,397,141 A | | 3/1995 | Hoshizaki et al. | 280/11.3 |
| 5,806,211 A | * | 9/1998 | Pozzobon | 36/15 |
| 5,842,706 A | * | 12/1998 | Chang | 280/11.28 |
| 5,887,877 A | * | 3/1999 | Nero | 280/11.221 |
| 6,029,983 A | | 2/2000 | Wegener | 280/11.22 |
| 6,113,123 A | * | 9/2000 | Cabanis et al. | 280/11.3 |
| 6,164,669 A | * | 12/2000 | Svensson | 280/11.3 |

FOREIGN PATENT DOCUMENTS

| | | |
|---|---|---|
| DE | 3043425 | 7/1982 |
| EP | 0551704 | 7/1993 |
| EP | 0891794 | 1/1999 |
| FR | 2755586 | 5/1998 |
| FR | 2766065 | 1/1999 |
| FR | 2766102 | 1/1999 |

* cited by examiner

*Primary Examiner*—J. J. Swann
*Assistant Examiner*—James S. McClellan
(74) *Attorney, Agent, or Firm*—Greenblum & Bernstein P.L.C.

(57) ABSTRACT

A skate having a fitting portion adapted to be fixed on the plate of a chassis supporting the gliding element for the practice of the so-called "aggressive" skating. The fitting portion includes a soft portion forming an upper, for a boot or low shoe, mounted on a rigid sole called the insole, a hard cradle adapted to receive the soft portion and formed of an integral shell cut at its front and lateral portion corresponding to the top of the foot and defining a sole adapted to be fixed on the chassis, from which extends, on the one hand, a heel stiffener capable of receiving a hinged rigid collar and, on the one hand, a protective band peripherally bordering the from and sides of the sole, in the extension of the heel stiffener, and an arrangement for assembling the soft portion on the hard cradle.

38 Claims, 2 Drawing Sheets

Fig. 1
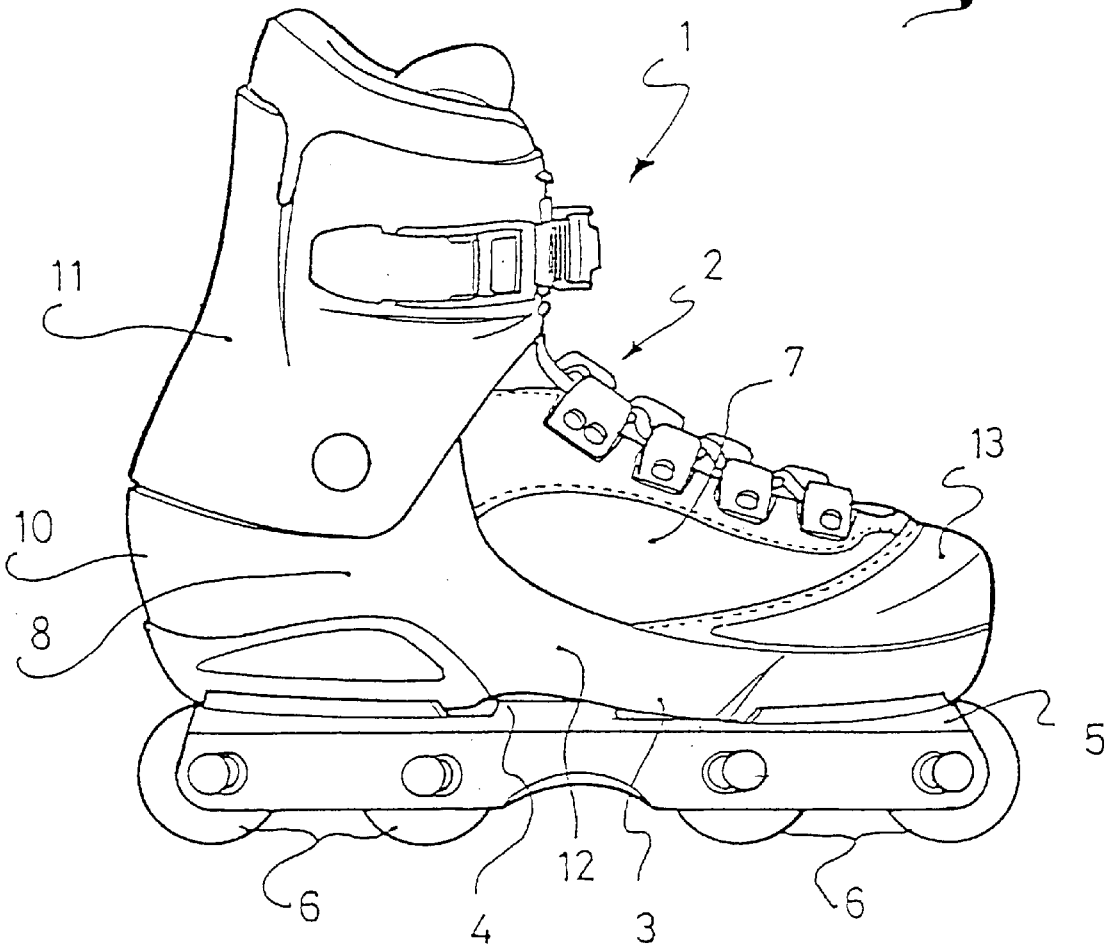
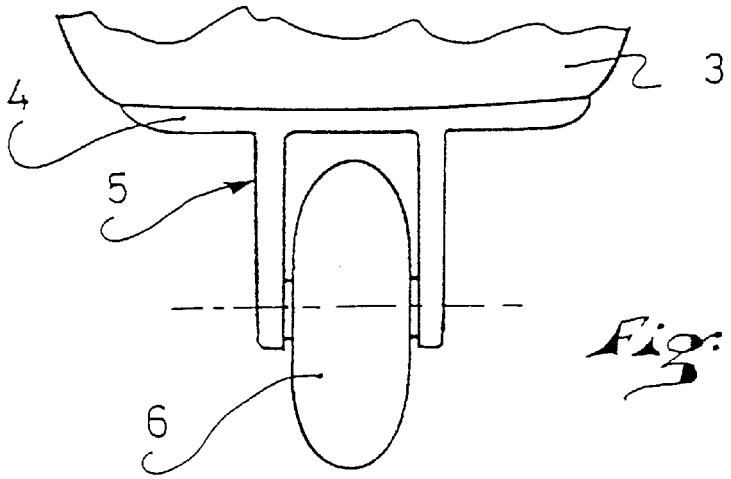
Fig. 2

SKATE, ESPECIALLY AN IN-LINE ROLLER SKATE, FOR "AGGRESSIVE" SKATING

BACKGROUND OF THE INVENTION

1. Field of the Invention

The present invention relates to a skate, especially an in-line roller skate or other skate, particularly adapted for so-called "aggressive" skating.

2. Description of Background and Relevant Information

In a known manner, a skate of the above-mentioned type is constituted, at its base, of a chassis having a longitudinal lower portion on which the gliding element, such as wheels or a blade, is arranged, and which is overlaid by a plate adapted to fix the fitting portion formed by an upper covering the user's foot, incorporating an outer sole and extending at its upper portion toward the user's ankle.

The skates adapted to this type of skating, called "aggressive skating", are fitted on the basis of this conventional design.

Particularly arrangements have been proven to be necessary for the practice of such a sport, which consists of gliding, not only by certain portions of the chassis, but also by certain portions of the upper on various supports, such as metallic rails, concrete walls, etc., and which prematurely wear the chassis and the boots themselves, because the later are very biased and, therefore, wear out very quickly.

To overcome this type of disadvantage, commonly owned French patent publication No. 2 766 065 discloses a skate having a front fitting portion forming the shell made of two different materials, one of which, relatively flexible, offers qualities of comfort and foot covering in certain zones, and the other of which, relatively rigid, constitutes reinforcements in different zones than the preceding zones, more particularly exposed to wear and tear, abrasion, and having superior qualities of mechanical resistance, this dual material zones of the shell being obtained by duplicate molding or bi-injection.

While this makes is possible to overcome the aforementioned disadvantages, it is however necessary to provide specific bi-injection molding tools for the manufacture of each model, because the two portions are closely connected and, therefore, involve specific constructions per model.

It is also known to overcome the aforementioned disadvantage by attaching protections made of reinforced metal or plastic on the shell, as described in the patent publication DE 296 12 211. These protections have the major disadvantage of being attached elements which necessitate additional labor costs.

Moreover, these reinforcements constitute extra thicknesses on the shell which increase the risks of hooking.

A skate is also known from commonly owned French patent publication No. 2 755 586, and corresponding U.S. patent application Ser. No. 08/963,630, whose fitting portion includes a soft upper associated with an insole adapted to be affixed to a rigid base defining both a sole adapted to be connected to the chassis of the skate, and a heel stiffener extending from the base and capable of receiving a hinged rigid collar adapted to surround the user's ankle.

While such a skate yields good results in conventional in-line roller skating, the protection is however insufficient in the so-called "aggressive" skating, because the peripheral edge of the soft upper is only protected at the rear, and not laterally.

SUMMARY OF THE INVENTION

To overcome all of the aforementioned disadvantages, the present invention relates to a skate having a fitting portion adapted to be fixed on the plate of a chassis supporting the gliding element for the practice of "aggressive" skating, wherein the fitting portion includes:

- a soft portion forming an upper mounted on a rigid sole, called the insole;
- a rigid cradle adapted to receive the soft portion and formed of an integral shell cut at its front and lateral portion corresponding to the top of the foot, and defining a sole adapted to be fixed on the chassis, extended by a heel stiffener capable of receiving a hinged rigid collar, on the one hand, and by a lateral protective band peripherally bordering the front and sides of the sole, in the extension of the heel stiffener, on the other hand; and
- an arrangement for assembling the soft portion on the cradle.

The present inventing also relates to the characteristics which will become apparent from the following description, and which must be considered separately or according to all of their possible technical combinations.

According to one aspect of the invention, there is provided a skate comprising a chassis supporting a gliding element for practicing aggressive skating, said chassis having an upwardly facing support plate. A boot fitting portion is fixed on the support plate, the fitting portion including a soft portion forming an upper mounted on a rigid sole, the rigid sole comprising an insole. A hard cradle is provided for receiving the soft portion and is formed of an integral shell cut at a front and lateral portion corresponding to a top of a foot of a wearer of the boot and defining a sole adapted to be fixed on the chassis, extended by a heel stiffener capable of receiving a hinged rigid collar and by a lateral protective band peripherally bordering front and sides of the sole, in the extension of the heel stiffener. An arrangement is provided for assembling the soft portion onto the cradle.

The soft portion may comprise a rigid toe-cup adapted to cooperate, for the assembly, with a corresponding front portion of the lateral rigid band for protecting the hard cradle. The arrangement assembling the soft portion onto the hard cradle forming the shell may comprise a groove provided at a front lower portion of a rigid toe-cup of the soft portion, capable of cooperating by nesting with a corresponding baffle obtained within the front portion of the band of the hard cradle, thus making it possible to obtain a perfect transmission between the two portions, and a second fixing mechanism arranged in the heel zone and inserted between the sole called the rigid insole of the soft portion and the sole of the hard cradle.

An internal wedging element made of an elastically deformable material may be arranged at the bottom of the hard cradle, in the heel area, to constitute both a shock-absorbing device and a device to adjust an inclination of the user's foot relative to the ground, by inducing a difference in height $\Delta h$ between the support plane of the heel of the foot and its plantar support plane in the area of the metatarsal bones.

The second fixing mechanism for fixing the soft portion on the hard cradle in the heel zone may comprise a screw extending through a hole punched in the heel zone of the sole of the hard cradle, said hole being made to coincide with a corresponding hole extending through the wedging element, such that the screw can be screwed, during the assembly, in a threaded blind barrel that is integral with the rigid sole, called the insole, of the soft portion, to obtain a unidirectional linkage allowing a relative top down vertical movement between the soft portion and the hard cradle, as a function of the level of compression of the shock absorbing element, without allowing any separation of one portion from the other.

The attachment by nesting of the soft portion on the rigid cradle may be secured by a screw-nut assembly extending through two smooth bores obtained in correspondence with one another in the sole of the hard cradle and in the rigid sole, called the insole, of the soft portion, in the zone of the metatarsal bones, respectively.

The invention provides for a skate comprising a chassis supporting a gliding element for practicing aggressive skating, the chassis including an upwardly facing support plate. A boot fitting portion including a soft upper portion and a rigid sole is included. A hard cradle is adapted to receive the boot fitting portion and having at least a partially open front portion. The hard cradle comprises a heel stiffener portion, a sole, and a lateral peripheral band bordering a front portion and side portions of the sole. The sole of the hard cradle is adapted to be fixed on the chassis. An internal wedging element comprises an elastically deformable material. The internal wedging element is disposed in a heel area of the hard cradle and being adapted to be trapped between the rigid sole of the boot fitting portion and the sole of the hard cradle. The internal wedging element is adapted to adjust an inclination of the rigid sole of the boot fitting portion relative to the sole of the hard cradle and to provide shock-absorption. A first fixing mechanism is arranged in a front portion of the skate for assembling the boot fitting portion onto the hard cradle. A second fixing mechanism is arranged in a heel portion of the skate for assembling the boot fitting portion onto the hard cradle. The second fixing mechanism is adjustable and comprises a screw which extends through an opening in the internal wedging element and a threaded blind barrel for fixing the rigid sole of the boot fitting portion to the sole of the hard cradle.

The invention also provides for a skate comprising a chassis supporting a gliding element, the chassis including a support plate. A boot fitting portion includes a soft upper portion and a rigid sole. A hard cradle is adapted to receive the boot fitting portion. The hard cradle comprises at least a heel stiffener portion, a sole, and a lateral peripheral band bordering a front portion and side portions of the sole. The sole of the hard cradle is adapted to be fixed to the chassis. A first fixing mechanism is arranged in a front portion of the skate for assembling the boot fitting portion onto the hard cradle. The first fixing mechanism comprises a groove which is adapted to cooperate with a corresponding baffle. A second fixing mechanism is arranged in a heel portion of the skate for adjustably assembling the boot fitting portion onto the hard cradle. The second fixing mechanism is adapted to vertically adjust a position of at least a portion of the rigid sole of the boot fitting portion relative to the sole of the hard cradle.

The second fixing mechanism may comprise a screw and barrel connection mechanism. The skate may further comprise an internal wedging element adapted to be disposed between the rigid sole of the boot fitting portion and the sole of the hard cradle. The skate may further comprise a rigid collar connected via a hinge to the heel stiffener. The hard cradle may comprise an integral shell having at least a partially open front portion. The heel stiffener may be adapted to receive a hinged rigid collar. The boot fitting portion may comprise a rigid toe-cup. The rigid toe-cup may comprise the groove of the first fixing mechanism and wherein the front portion of the hard cradle comprises the baffle of the first fixing mechanism. The skate may further comprise a third fixing mechanism for fixing the boot fitting portion to the hard cradle. The third fixing mechanism may fix the rigid sole of the boot fitting portion to the sole of the hard cradle. The skate may further comprise an internal wedging element comprising an elastically deformable material, the internal wedging mechanism being arranged in a heel area of the hard cradle and providing shock-absorption.

The internal wedging mechanism may be adapted to adjust an inclination of the rigid sole of the boot fitting portion relative to the sole of the hard cradle. The second fixing mechanism may comprise a screw extending through a hole in the sole of the hard cradle. The skate may further comprise an internal wedging element, wherein the screw extends through an opening in the internal wedging element to connect the sole of the hard cradle to the rigid sole of the boot fitting portion so as to trap the internal wedging element. The internal wedging element and the screw may cooperate to adjust a relative top down vertical movement between the boot fitting portion and the hard cradle and to provide shock absorption without allowing the boot fitting portion to separate from the hard cradle. The skate may further comprise a screw-nut assembly for additionally connecting, through an opening in the rigid sole of the boot fitting portion and an opening in the sole of the hard cradle, the boot fitting portion with the hard cradle.

The invention also contemplates a skate comprising a chassis supporting a gliding element. A boot fitting portion including a soft upper portion and a rigid sole is provided. A hard cradle is adapted to receive the boot fitting portion. The hard cradle comprises at least a heel stiffener portion, a sole, and a lateral peripheral band bordering a front portion and side portions of the sole. The sole of the hard cradle is adapted to be fixed to the chassis. An internal wedging element comprises an elastically deformable material. The internal wedging element is disposed in a heel area of the hard cradle and is adapted to be trapped between the rigid sole of the boot fitting portion and the sole of the hard cradle. The internal wedging element is adapted to adjust an inclination of the rigid sole of the boot fitting portion relative to the sole of the hard cradle to provide shock-absorption. At least one fixing mechanism for assembling the boot fitting portion onto the hard cradle is included.

The at least one fixing mechanism may comprise a first fixing mechanism. The first fixing mechanism may be arranged in a front portion of the skate for assembling the boot fitting portion onto the hard cradle. The first fixing mechanism may comprise a groove which is adapted to cooperate with a corresponding baffle. The skate may further comprise a second fixing mechanism arranged in a heel portion of the skate for adjustably assembling the boot fitting portion onto the hard cradle. The second fixing mechanism may be adapted to vertically adjust a position of the rigid sole of the boot fitting portion relative to the sole of the hard cradle. The second fixing mechanism may comprise a screw and barrel connection mechanism. The skate may further comprise a rigid collar connected via a hinge to the heel stiffener. The hard cradle may comprise an integral shell having at least a partially open front portion. The heel stiffener may be adapted to receive a hinged rigid collar. The boot fitting portion may comprise a rigid toe-cup.

The at least one fixing mechanism may comprise a groove arranged on the toe-cup and wherein the front portion of the hard cradle comprises a baffle which cooperates with the groove to affix the boot fitting portion to the hard cradle. The at least one fixing mechanism may comprise three fixing mechanisms for fixing the boot fitting portion to the hard cradle. The first fixing mechanism may comprise a groove arranged on a toe-cup which cooperates with a baffle on the front portion of the hard cradle and wherein the second and third fixing mechanisms each comprise a screw connection mechanism. Each of the second and third fixing mechanisms may fix the rigid sole of the boot fitting portion to the sole of the hard cradle. The second fixing mechanism may trap the internal wedging element in the heel area of the hard cradle and wherein the third fixing mechanism fixes a front portion of the rigid sole of the boot fitting portion to a front portion of the sole of the hard cradle. The second fixing mechanism may comprise a screw extending through a hole in the sole of the hard cradle. The screw may extend through an opening in the internal wedging element to connect the sole of the hard cradle to the rigid sole of the boot fitting portion so as to trap the internal wedging element.

The internal wedging element and screw may cooperate to adjust a relative top down vertical movement between the boot fitting portion and the hard cradle and to provide shock absorption without allowing the boot fitting portion to separate from the hard cradle. The internal wedging mechanism may be adapted to adjust an inclination of the rigid sole of the boot fitting portion relative to the sole of the hard cradle by inducing a difference in height Ah between a support plane of the rigid sole of the boot fitting portion and the sole of the hard cradle.

According to another aspect of the invention, there is provided a skate comprising a chassis supporting a gliding element. A boot fitting portion includes a soft upper portion and a rigid sole. A hard cradle is adapted to removably receive the boot fitting portion. The hard cradle comprises at least a heel stiffener portion, a sole, and a lateral peripheral band bordering a front portion and side portions of the sole. The rigid sole of the boot fitting portion is adapted to be removably fixed to at least one of the hard cradle and the chassis. The sole of the hard cradle is adapted to be fixed to the chassis. The skate further comprises at least one of a first fixing mechanism arranged in a front portion of the skate for assembling the boot fitting portion onto the hard cradle, the first fixing mechanism comprising a groove which is adapted to cooperate with a corresponding baffle and a second fixing mechanism arranged in a heel portion of the skate for adjustably assembling the boot fitting portion onto the hard cradle, wherein the second fixing mechanism is adapted to vertically adjust a position of at least a portion of the rigid sole of the boot fitting portion relative to the sole of the hard cradle, and an internal wedging element comprising an elastically deformable material, the internal wedging element being disposed in a heel area of the hard cradle and being adapted to be trapped between the rigid sole of the boot fitting portion and the sole of the hard cradle, the internal wedging element being adapted to adjust an inclination of the rigid sole of the boot fitting portion relative to the sole of the hard cradle to provide shock-absorption, and at least one fixing mechanism for assembling the boot fitting portion onto the hard cradle.

BRIEF DESCRIPTION OF DRAWINGS

This description of an in-line roller skate is provided by way of a non-liming example, and will help to better understand how the invention can be embodied, with reference to the annexed drawings in which:

FIG 1 is a lateral view of an in-line roller skate according to the invention;

FIG. 2 is an elevation view of the front of the skate, more particularly showing the profile of the chassis.

DETAILED DESCRIPTION OF THE INVENTION

Figure 3:
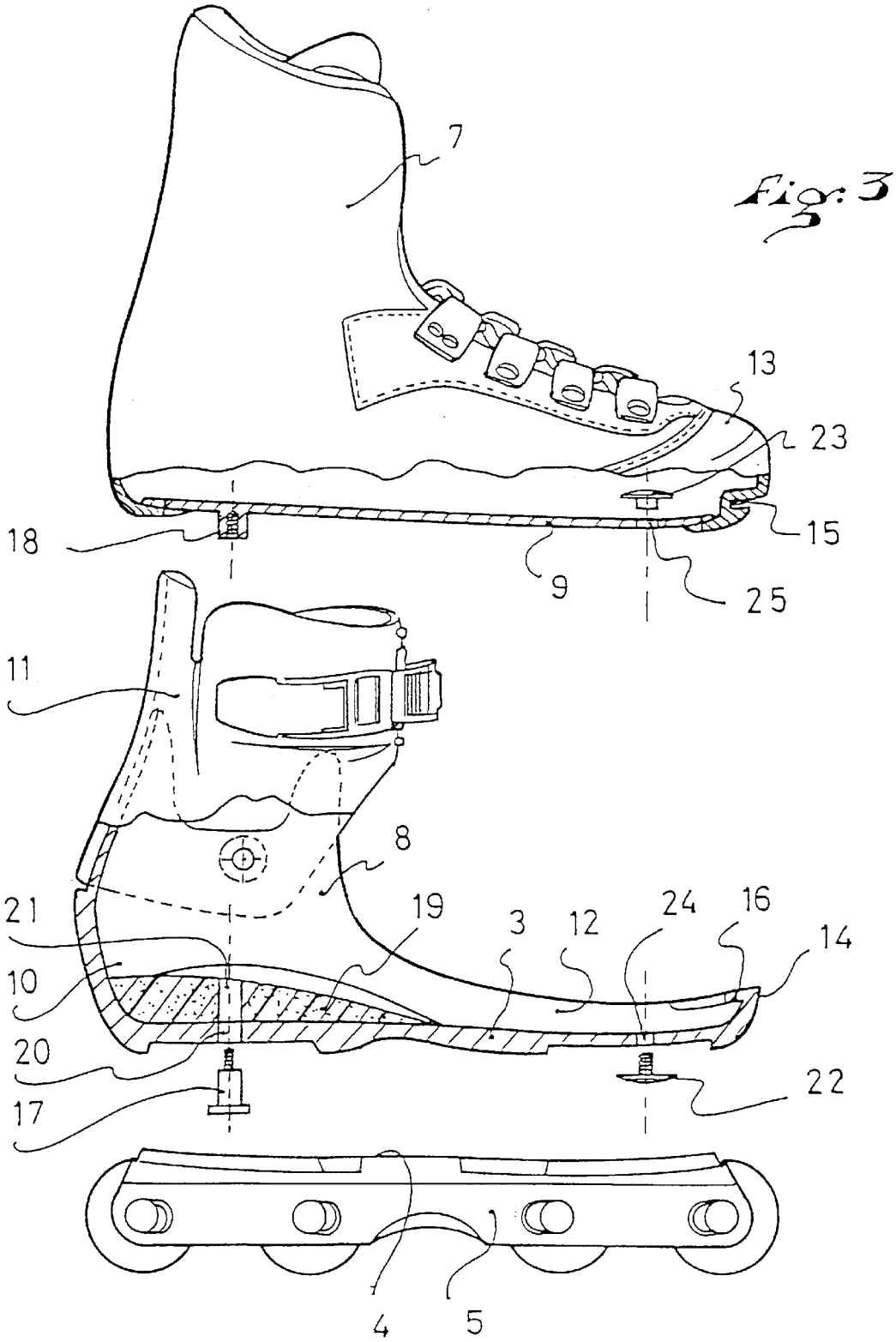
FIG. 3 is an exploded view of the various constituent portions of a skate according to FIG. 1.

The in-line roller skate, generally designated by the reference numeral 1 and shown in FIGS. 1, 2, and 3, is more particularly adapted to the so-called "aggressice" skating.

It is constituted by a chassis 5 having a horizontal plate 4, which can be made in one or more portions, extended by two vertical wings. This plate 4 forms the support and is adapted to fix the fitting portion 2, as known, in the heel and forefoot zones.

The two vertical lateral wings, parallel with one another, are arranged on both sides of the wheels and support their fitting pins.

The fillting portion 2 includes a soft portion forming the upper 7 with a rigid sole 9 forming an insole, for a boot or low shoe, mounted on a rigid sole 3.

The fitting portion 2 also has a hard portion called the cradle 8, adapted to receive the soft portion 7, which is formed of an integral shell cut at its front and lateral portion corresponding to the top of the foot. The hard cradle 8 includes a sole 3 fixed on the chassis 5 extending by a heel stiffener 10 capable of receiving a hinged rigid collar 11, on the one hand, and by a protective band 12 peripherally bordering the front and sides of the sole 3, in the extension of the heel stiffener 10, on the other hand.

It is to be understood that such a design efficiently ensures the protection of the soft portion as well as of the zones that are sensitive to impact, and especially offers a gliding quality and an unquestionable durability of the zones subject to the constant frictions associated with the practice of this type of sport; these zones being generally located in the lateral bottom portion and around the boot, at its lower portion.

The skate also includes an arrangement which provides for assembling the soft portion 7 onto the cradle 8. In this regard, the soft portion 7 has a rigid toe-cup 13 adapted to cooperate fixedly with a corresponding front portion 14 of the lateral protective band 12.

This arrangement for fixing the soft portion 7 on the hard cradle 8 forming the shell include, on the one hand, a groove 15 provided on the front lower portion of its rigid toe-cup 13, which is capable of cooperating by nesting with a complementary baffle 16 obtained within the front portion 14 of the rigid band 12 of the cradle 8, thereby making it possible to obtain a perfect transmission between the two portions 7, 8 and, on the other hand, a second fixing mechanism 17, 18, inserted between the rigid insole 9 of the soft portion 7 and the sole 3 of the hard cradle 8 arranged in the heel zone.

Furthermore, the skate has an internal wedging element 19 made of an elastically deformable material arranged at the bottom of the cradle 8, in the heel area 10, to constitute both a shock-absorbing arrangement and an arrangement for adjusting the inclination of the user's foot relative to the ground, by inducing a difference in height $\Delta h$ between the support plane of the heel of the foot and its plantar support plane in the area of the metatarsal bones.

The internal wedging element 19 is a piece made of an elastically deformable material that is attached removably so as to allow the interchangeability with wedging elements of different heights capable of providing different heights $\Delta h$.

For more details regarding the making of such a wedging element, reference is made to commonly owned French patent publication No. 2 766 102, and corresponding U.S. patent application Ser. No. 09/115,550, the disclosures of which are hereby incorporated by reference thereto in their entireties.

According to the present embodiment, the second arrangement for fixing the soft portion 7 on the hard cradle 8 forming the shell includes a screw 17 extending through a hole 20 punched in the heel zone 10 of the rigid sole 3 of the hard cradle 8. This hole 20 is made to coincide with a hole 21 extending through the shock-absorbing element 19, such that the screw 17 can be screwed, during the assembly, in a threaded blind barrel 18 integral with the rigid insole 9 of the soft portion 7, to obtain a unidirectional linkage allowing a relative top down vertical movement between the two portions 7, 8, as a function of the level of compression of the shock-absorbing element 19, without allowing any separation of one portion from the other.

According to an improvement of the invention, the attachment by nesting at the front of the soft portion 7 on the hard cradle 8 is secured by a screw-nut assembly 22, 23 extending through two smooth bores 24, 25 obtained in correspondence with one another in the rigid sole 3 of the cradle 8 and in the rigid insole 9 of the soft portion 7, in the zone of the netatarsal bones, respectively.

According to the invention that has just been described, a hard-soft assembly is obtained which allows an optimal transmission on the front of the upper, and a maximum shock-absorption beneath the rear of the upper, while protecting the entire boot in service areas.

The instant application is based upon the French Patent Application No. 99.03492, filed Mar. 15, 1999, disclosure of which is hereby incorporated by reference thereto in its entirety, and the priority of which is hereby claimed under 35 U.S.C. §119.

What is claimed is:

1. A skate comprising:

a chassis supporting a gliding element for practicing aggressive skating, the chassis including an upwardly facing support plate;

a boot fitting portion including a soft upper portion and a rigid sole;

a hard cradle adapted to receive the boot fitting portion and having at least a partially open front portion;

the hard cradle comprising a heel stiffener portion, a sole, and a lateral peripheral band bordering a front portion and side portions of the sole;

the sole of the hard cradle being adapted to be fixed on the chassis;

an internal wedging element comprising an elastically deformable material;

the internal wedging element being disposed in a heel area of the hard cradle and being adapted to be trapped between the rigid sole of the boot fitting portion and the sole of the hard cradle;

the internal wedging element being adapted to adjust an inclination of the rigid sole of the boot fitting portion relative to the sole of the hard cradle and to provide shock-absorption;

a first fixing mechanism arranged in a front portion of the skate for assembling the boot fitting portion onto the hard cradle;

a second fixing mechanism arranged in a heel portion of the skate for assembling the boot fitting portion onto the hard cradle; and the second fixing mechanism being adjustable and comprising a screw which extends through an opening in the internal wedging element and a threaded blind barrel for fixing the rigid sole of the boot fitting portion to the sole of the hard cradle.

2. A skate comprising:

a chassis supporting a gliding element;

a boot fitting portion including a soft upper portion and a rigid sole;

a hard cradle adapted to receive the boot fitting portion;

the hard cradle comprising at least a heel stiffener portion, a sole, and a lateral peripheral band bordering a front portion and side portions of the sole;

the sole of the hard cradle being adapted to be fixed to the chassis;

a first fixing mechanism arranged in a front portion of the skate for assembling the boot fitting portion to the hard cradle;

the first fixing mechanism comprising a groove which is adapted to cooperate with a corresponding baffle;

a second fixing mechanism arranged in a heel portion of the skate for adjustably assembling the boot fitting portion to the hard cradle; and the second fixing mechanism being adapted to vertically adjust a position of at least a portion of the rigid sole of the boot fitting portion relative to the sole of the hard cradle.

3. The skate of claim 2, wherein the second fixing mechanism comprises a screw and barrel connection mechanism.

4. The skate of claim 2, further comprising an internal wedging element adapted to be disposed between the rigid sole of the boot fitting portion and the sole of the hard cradle.

5. The skate of claim 2, further comprising a rigid collar connected via a hinge to the heel stiffener.

6. The skate of claim 2, wherein the hard cradle comprises an integral shell having at least a partially open front portion.

7. The skate of claim 2, wherein the heel stiffener is adapted to receive a hinged rigid collar.

8. The skate of claim 2, wherein the boot fitting portion comprises a rigid toe-cup.

9. The skate of claim 8, wherein the rigid toe-cup comprises the groove of the first fixing mechanism and wherein the front portion of the hard cradle comprises the baffle of the first fixing mechanism.

10. The skate of claim 2, further comprising a third fixing mechanism for fixing the boot fitting portion to the hard cradle.

11. The skate of claim 10, wherein the third fixing mechanism fixes the rigid sole of the boot fitting portion to the sole of the hard cradle.

12. The skate of claim 2, further comprising an internal wedging element comprising an elastically deformable material, the internal wedging mechanism being arranged in a heel area of the hard cradle and providing shock-absorption.

13. The skate of claim 12, wherein the internal wedging mechanism is adapted to adjust an inclination of the rigid sole of the boot fitting portion relative to the sole of the hard cradle.

14. The skate of claim 2, wherein the second fixing mechanism comprises a screw extending through a hole in the sole of the hard cradle.

15. The skate of claim 14, further comprising an internal wedging element having an opening, wherein the screw extends through the opening in the internal wedging element to connect the sole of the hard cradle to the rigid sole of the boot fitting portion so as to trap the internal wedging element therebetween.

16. The skate of claim 15, wherein the internal wedging element and screw cooperate to adjust a relative top down vertical movement between the boot fitting portion and the hard cradle and to provide shock absorption without allowing the boot fitting portion to separate from the hard cradle.

17. The skate of claim 2, further comprising a screw-nut assembly for additionally connecting, through an opening in the rigid sole of the boot fitting portion and an opening in the sole of the hard cradle, the boot fitting portion with the hard cradle.

18. A skate comprising:

a chassis supporting a gliding element;

a boot fitting portion including a soft upper portion and a rigid sole;

a hard cradle adapted to receive the boot fitting portion;

the hard cradle comprising at least a heel stiffener portion, a sole, and a lateral peripheral band bordering a front portion and side portions of the sole;

the sole of the hard cradle being adapted to be fixed to the chassis;

an internal wedging element comprising an elastically deformable material;

the internal wedging element being disposed in a heel area of the hard cradle and being adapted to be trapped between the rigid sole of the boot fitting portion and the sole of the hard cradle;

the internal wedging element being adapted to adjust an inclination of the rigid sole of the boot fitting portion relative to the sole of the hard cradle and to provide shock-absorption; and at least one fixing mechanism for assembling the boot fitting portion onto the hard cradle.

19. The skate of claim 18, wherein the at least one fixing mechanism comprises a first fixing mechanism.

20. The skate of claim 19, wherein the first fixing mechanism is arranged in a front portion of the skate for assembling the boot fitting portion onto the hard cradle.

21. The skate of claim 19, wherein the first fixing mechanism comprises a groove which is adapted to cooperate with a corresponding baffle.

22. The skate of claim 20, further comprising a second fixing mechanism arranged in a heel portion of the skate for adjustably assembling the boot fitting portion onto the hard cradle.

23. The skate of claim 22, wherein the second fixing mechanism is adapted to vertically adjust a position of the rigid sole of the boot fitting portion relative to the sole of the hard cradle.

24. The skate of claim 22, wherein the second fixing mechanism comprises a screw and barrel connection mechanism.

25. The skate of claim 18, further comprising a rigid collar connected via a hinge to the heel stiffener.

26. The skate of claim 18, wherein the hard cradle comprises an integral shell having at least a partially open front portion.

27. The skate of claim 18, wherein the heel stiffener is adapted to receive a hinged rigid collar.

28. The skate of claim 18, wherein the boot fitting portion comprises a rigid toe-cup.

29. The skate of claim 28, wherein the at least one fixing mechanism comprises a groove arranged on the toe-cup and wherein the front portion of the hard cradle comprises a baffle which cooperates with the groove to removably affix the boot fitting portion to the hard cradle.

30. The skate of claim 18, wherein the at least one fixing mechanism comprises first, second and third fixing mechanisms for fixing the boot fitting portion to the hard cradle.

31. The skate of claim 30, wherein the first fixing mechanism comprises a groove arranged on a toe-cup which cooperates with a baffle on the front portion of the hard cradle and wherein the second and third fixing mechanisms each comprise a screw connection mechanism.

32. The skate of claim 31, wherein each of the second and third fixing mechanisms fix the rigid sole of the boot fitting portion to the sole of the hard cradle.

33. The skate of claim 32, wherein the second fixing mechanism traps the internal wedging element in the heel area of the hard cradle and wherein the third fixing mechanism fixes a front portion of the rigid sole of the boot fitting portion to a front portion of the sole of the hard cradle.

34. The skate of claim 33, wherein each of the second and third fixing mechanisms comprises a screw extending through a hole in the sole of the hard cradle.

35. The skate of claim 34, wherein the screw of the second fixing mechanism extends through an opening in the internal wedging element to connect the sole of the hard cradle to the rigid sole of the boot fitting portion so as to trap the internal wedging element.

36. The skate of claim 35, wherein the internal wedging element and screw cooperate to adjust a relative top down vertical movement between the boot fitting portion and the hard cradle and to provide shock absorption without allowing the boot fitting portion to separate from the hard cradle.

37. The skate of claim 18, wherein the internal wedging mechanism is adapted to adjust an inclination of the rigid sole of the boot fitting portion relative to the sole of the hard cradle.

38. A skate comprising:

a chassis supporting a gliding element;

a boot fitting portion including a soft upper portion and a rigid sole;

a hard cradle adapted to removably receive the boot fitting portion;

the hard cradle comprising at least a heel stiffener portion, a sole, and a lateral peripheral band bordering a front portion and side portions of the sole;

the rigid sole of the boot fitting portion being adapted to be removably fixed to at least one of the hard cradle and the chassis;

the sole of the hard cradle being adapted to be fixed to the chassis;

the skate further comprising at least one of:

a first fixing mechanism arranged in a front portion of the skate for assembling the boot fitting portion onto the hard cradle, the first fixing mechanism comprising a groove which is adapted to cooperate with a corresponding baffle and a second fixing mechanism arranged in a heel portion of the skate for adjustably assembling the boot fitting portion onto the hard cradle, wherein the second fixing mechanism is adapted to vertically adjust a position of at least a portion of the rigid sole of the boot fitting portion relative to the sole of the hard cradle; and an internal wedging element comprising an elastically deformable material, the internal wedging element being disposed in a heel area of the hard cradle and being adapted to be trapped between the rigid sole of the boot fitting portion and the sole of the hard cradle, the internal wedging element being adapted to adjust an inclination of the rigid sole of the boot fitting portion relative to the sole of the hard cradle and to provide shock-absorption, at least one fixing mechanism for assembling the boot fitting portion onto the hard cradle.

* * * * *